United States Patent [19]

Whitehead

[11] Patent Number: 4,711,445

[45] Date of Patent: Dec. 8, 1987

[54] THERAPEUTIC HAND EXERCISER

[75] Inventor: Edward J. Whitehead, Lititz, Pa.

[73] Assignee: Duro Med Industries, Inc., Hackensack, N.J.

[21] Appl. No.: 299,080

[22] Filed: Sep. 3, 1981

[51] Int. Cl.[4] ..... A63B 21/30

[52] U.S. Cl. ..... 272/67

[58] Field of Search ..... 128/26, 260, DIG. 15; 272/67, 68, 70, 122; 273/67 B, DIG. 30; D21/198; 604/291, 292, 295

[56] References Cited

U.S. PATENT DOCUMENTS

| | | | |
|---|---|---|---|
| 1,549,710 | 1/1924 | Cambell | 272/68 |
| 2,103,526 | 12/1937 | Goodman | 132/41 B X |
| 2,114,790 | 4/1938 | Venables | 272/119 |
| 2,634,976 | 4/1953 | Mock | 272/68 |
| 2,700,832 | 2/1955 | Slovinski | 272/119 X |
| 2,888,016 | 5/1959 | De Lamater | 604/293 |
| 3,413,243 | 11/1968 | Griffin | 272/68 |
| 3,500,837 | 7/1968 | Ferens | 132/40 |
| 3,530,863 | 9/1970 | Foster | 132/33 B |
| 3,542,363 | 11/1970 | Bishop | 272/68 |
| 3,640,532 | 2/1972 | Bauer | 273/1.5 A |
| 3,937,233 | 2/1976 | Hook | 132/40 |
| 4,105,200 | 8/1978 | Unger | 272/68 X |
| 4,240,624 | 12/1980 | Wilson | 272/68 |
| 4,286,608 | 9/1981 | Handley et al. | 132/40 |
| 4,310,008 | 1/1982 | Lalli | 132/40 |

FOREIGN PATENT DOCUMENTS

| | | | |
|---|---|---|---|
| 2196820 | 3/1974 | France | 604/292 |
| 27934 | of 1905 | United Kingdom | 272/68 |
| 456223 | 11/1936 | United Kingdom | 272/68 |
| 550961 | 2/1943 | United Kingdom | 272/68 |

*Primary Examiner*—Richard J. Apley
*Assistant Examiner*—S. R. Crow
*Attorney, Agent, or Firm*—Fleit, Jacobson, Cohn & Price

[57] ABSTRACT

A therapeutic hand exerciser constructed of resilient foam material such as polyurethane of generally cylindrical configuration with an opening passing through an axis thereof, and a strap formed of two "Velcro" (a trademark) woven nylon fastener material joined together passing through the opening and adjustably fastened together at each of the free ends around one's hand or other body member for being adjustable to fit any sized hands or body members. A longitudinal groove extends throughout a length of the material upon the cylindrical surface for receiving within such cut or groove a medicinal substance such as sold under the trademark "Ben Gay", ointment, or other medicament that is applied to the engaging body member.

2 Claims, 3 Drawing Figures

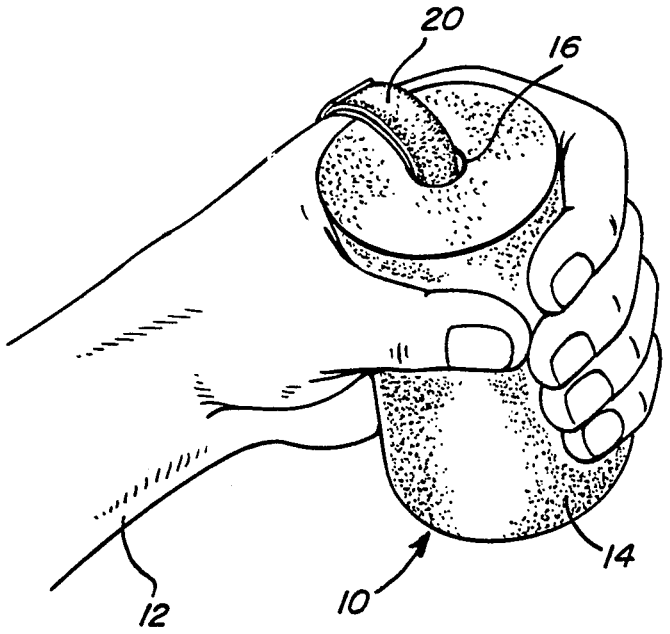
Fig. 1
Fig. 2
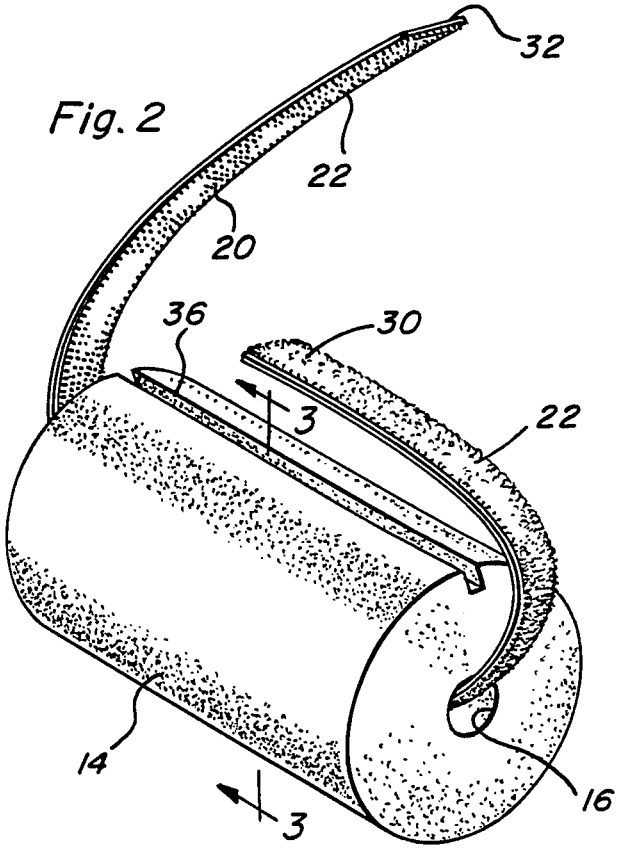
Fig. 3
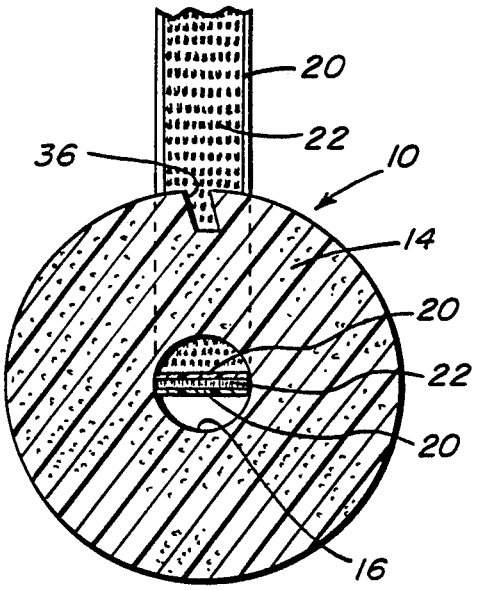

THERAPEUTIC HAND EXERCISER

BRIEF DESCRIPTION OF THE INVENTION

The invention relates to a therapeutic hand exerciser made of polyurethane foam supported by retaining straps and having a slit or groove therein for retaining medicinal substance such as ointments and the like. More particularly the invention is directed to a strap supported hand held exerciser having a groove in a resilient material forming the exerciser for providing further relief when utilized for exercising and therapeutic purposes.

BACKGROUND OF THE INVENTION

Physical exercising apparatus have been designed for compact and portable use in which muscles and tendons of the fingers, hands, wrists and forearms are used in physical exercises. While there has been a tremendous increase in personal engagement in sports such as golf, tennis and other sporting activity together with utilizing equipment which is used to exercise and train body members by use of such equipment, there has been a correspondingly substantial increase in various arm and hand ailments and which do not provide for application of medicinal ointments while the exercise device is otherwise physically and therapeutically in use.

FIELD OF THE INVENTION

It is within the purview of the present invention to provide a therapeutic hand exerciser device or apparatus made of resilient or elastomeric material and which may be polyurethane foam material having an elongated cylindrical configuration, a hollow opening through an axis of the hand exerciser that may lend to some flexibility of the material during its therapeutic applications and uses, and in which straps having "Velcro" fastener elements thereon extend through the opening and about one's body member or hand. Thus the polyurethane foam cylinder and hand exerciser of the invention may be adjustable by the manner in which the ends of the straps are connected or coupled for preventing the exerciser from dropping off of one's hand or body member and wherein the hand strap assembly can be adjusted to fit all sizes of hands.

DESCRIPTION OF THE PRIOR ART

Some therapeutic body member and hand exerciser apparatus are known such as hand and finger exercising devices having a member with elastic retaining straps disposed around a body member or hand for securing it to the user. Such devices are made of plastic, resilient material and are adapted to be grasped during exercise and therapeutic uses in which a resilient deformable material provide uses of a therapeutic and exercising nature. There are no known exercising devices showing a "Velcro" fastener material passing through a hollow axial opening within the material in which the opening augments the resiliency and exercising nature of the exerciser device and in which a medicinal substance or material such as in the nature of an ointment is disposed along a slot or cut in the peripheral surface of the hand exerciser. Various prior art patents showing some of the above features and related devices and methods of hand exercising typical of what is described above are:

| | | |
|---|---|---|
| U.S. Pat. No. 1,549,710 | G. Campbell | August 11, 1925 |
| U.S. Pat. No. 3,413,243 | D. H. Griffin | November 26, 1968 |
| U.S. Pat. No. 3,542,363 | K. J. Bishop, et al | November 24, 1970 |
| U.S. Pat. No. 4,105,200 | A. Unger | August 8, 1978 |
| U.S. Pat. No. 4,240,624 | Wilson | December 23, 1980 |

None of these patents show features, structures or functions related to the present invention and none of these patents, whether taken and viewed singly or in combination with each other, are believed to have a bearing on the patentability of any claim of the invention.

SUMMARY OF THE INVENTION

An object and advantage of the present invention is to provide a new and improved therapeutic hand exerciser apparatus made of a resilient material such as polyurethane foam having a set of "Velcro" fastener straps useful for adjustably being secured about one's body member such as a hand, and being adjustable to fit all sizes of hands and the like.

Another and additional object of the present invention is to provide a therapeutic hand exerciser apparatus with an adjustable "Velcro" strap fastener to fit within one's hand so that the exerciser is not accidently or carelessly dropped from one's hand, particularly since the hand exerciser may contain specific formulations and selected prescriptions of ointments, medical or medicinal substances such as "Ben Gay" or other type of ointments for providing relief when the exerciser device is being utilized for the proposed medicinal and therapeutic purposes.

A further and additional object of the present invention is to provide a hand exerciser that is constructed and arranged to be provided with a cut, slit or groove within a periphery of the device for receiving medicinal substances that are thereby available for being worked into the active surface of one's body member, hand, forearm, wrist or other like body member which is receiving the therapeutic and exercise action.

Another and further object of the invention is to provide therapeutic hand exercising of a selected body member in which exercises are aimed at making sure affected joints are being moved through their full range of motion, whether being performed by the patient individually and alone or with assistance of a physical therapist or other trained person so that the therapeutic and medicinal assistance by use of the apparatus of the invention is achieved. In this way and pursuant to this objective, a maximum degree of physical function is essentially restored by helping the patient make use of a best use of his remaining abilities.

Another object, feature and advantage of the present invention is to provide sets of adjustable "Velcro" strap fasteners having mating component parts so that a therapeutic hand exerciser may readily fit within any of various sized hands for having the exerciser being retained therein.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

FIG. 1 is a perspective view of a therapeutic hand exerciser apparatus according to a preferred embodiment of the present invention.

FIG. 2 is a perspective view without showing it being grasped by one's hand and in which the strap arrangement is shown in open position.

FIG. 3 is a sectional view taken along line 3—3 of FIG. 2.

DETAILED DESCRIPTION OF THE PREFERRED EMBODIMENT

Referring now to the drawings there is shown a therapeutic hand exerciser apparatus 10 shown being grasped within the palm of one's hand 12 for use in a therapeutic and exercise mode according to the invention. The hand exerciser apparatus 10 is a foam structure or material 14 that is preferably resilient foam material such as polyurethane or other and similar elastomeric materials.

There is an opening 16 of generally cylindrical configuration passing essentially axially through the entire length of the oblong or elongated cylindrical configuration of the foam structure 14. A strap 20 passes through the opening 16 and is fastened about and securely upon the body member 12 as shown in FIG. 1 and in the drawings it is exemplary that the strap 20 comprises a "Velcro" fastener material consisting of a woven nylon hook and loop fastener structure 22. The entire strap 20 consists of two such "Velcro" fasteners disposed in mating relation near the center of the hollow cylinder 16 as is shown in FIG. 3 in which the ends within the cylinder 16 are joined forming the "Velcro" fastener in mutually mating relation, and similarly the free ends 30, 32 shown in FIG. 2 may be wrapped about one's hand or body member as appropriate so that these ends 30, 32 may engage each other in mating relation forming a "Velcro" fastener arrangement as described above. Within the peripheral surface of the foam structure 14 and extending essentially along the entire length thereof is a cut, slit or elongated aperture 36 for retaining medicinal substances or prescriptions (not shown) such as "Ben Gay" or other type of exercising and relief giving ointments that may work into one's body muscles, joints, and adjacent skin surface for achieving therapeutic and exercising relief functions during the exercising operation.

The given lengths of "Velcro" fastener straps 20, 20 may be of a common length but need not be in all cases. The "Velcro" fastener material may be of generally equal lengths but are fastened together at each end thereof, one set of ends being within the hollow cylinder 16 and the other generally formed adjacent one's body member or hand as is the case shown in FIG. 1 where the fastening is not in view but disposed near the back of the hand of body member 12.

Within the groove 36 there is provided spaces for and received therein a medicament, salve, medicinal ointment or the like, a medicinal substance or prescription such as "Ben Gay", or similar relief giving ointment where it is desired to be worked and affect one's adjacent joints, body surfaces and related areas of the body member proximate to the therapeutic hand exerciser 10 and the groove 36.

By arrangement of the groove 36 disposed adjacent to one's body member disposed under the strap 20 as is shown in FIG. 1, the material or ointment or substance within the groove 36 dissipates upon the body member during exercise and provides relief, augments a therapeutic effect and aids in the exercise in some way while being used. Dispensing such ointments to adjacent parts of the body member restores essentially some maximum degree of physical recovery not heretofore known, and it is found that the straps 20, 20 provide adjustment in use regardless of the size of one's hand or body member; the straps also prevent the therapeutic hand exerciser from being dropped or lost during intermittent or continual uses.

It is within the purview of the present invention to provide the straps being received at the ends of the foam structure and more particularly that they be conjoined within the hollow cylinder 16, and in this way the straps are capable of being disposed in a mating relationship so that the "Velcro" fastener surfaces 22, 22 may be secured together. Maximum adjustment and versatility is provided where the "Velcro" woven nylon fastener material extends throughout substantially the entire length of one side of each of the straps 20, 20.

The foregoing is considered as illustrative only of the principles of the invention. Further, since numerous modifications and changes will readily occur to those skilled in the art, it is not desired to limit the invention to the extact construction and operation shown and described, and accordingly, all suitable modifications and equivalents may be resorted to, falling within the scope of the invention.

What is claimed as new is as follows:

1. A hand exerciser comprising an elongated imperforate cylindrical body constructed of resilient flexible material and having a substantially constant diameter throughout its length, said body including a cylindrical bore extending throughout its length and located in the center of the body, said body having flat ends perpendicular to the longitudinal axis of the body, the diameter of the body being substantially greater than the diameter of the bore to provide a radially thick body outwardly of the bore, said body having a length enabling it to extend substantially completely across the width of the palm of a hand of a user and a circumference enabling the fingers and thumb on the hand of a user to substantially encircle the body when the body is uncompressed thereby enabling the body to be compressed anywhere along its length or throughout its length by the user squeezing the body thereby exercising the hand, and a flexible retaining strap extending through the bore and encircling the back of the hand to retain the body against the palm of the hand even when the fingers and thumb are not in encircling relation to the body, said strap having a width generally equal to the diameter of the bore to stabilize the strap in the bore, said body being constructed of cellular foam material with the bore through the body enabling compression of the body to a thin configuration by collapsing the bore as well as collapsing the cellulose foam material thereby enabling the hand to be tightly clinched to form a fist, said strap extending through the bore including overlapping ends and means adjustably interconnecting the overlapping ends of the strap to enable the strap to snugly encircle hands having different dimensions, the external surface of said body including a longitudinally extending ointment receiving and dispensing groove means, said groove means terminating in radially spaced relation to the bore and extending throughout the length of the body and oriented in facing contacting relation to the user's hand for applying ointment to the hand during cyclic compression of the body.

2. The method of exercising the hand by using the hand exerciser as defined in claim 1 consisting of the steps of placing the body transversely across the palm of the hand with the strap disposed across the back of the hand generally in opposed relation to the area of contact between the palm and said body, encircling the body by moving the fingers and thumb towards each other around the periphery of the body and cyclically squeezing said body by using all of the fingers and thumb or any selective combination thereof, and placing ointment in said groove means before placing the body across the palm of the hand and aligning the groove means with the area of the hand to which ointment is to be applied by rotating the body in relation to the strap extending through the bore.

* * * * *